United States Patent [19]

Cortimilia

[11] 4,140,320

[45] Feb. 20, 1979

[54] CARD GAME

[76] Inventor: Richard A. Cortimilia, 4 Ecoway Ct., Towson, Md. 21204

[21] Appl. No.: 836,429

[22] Filed: Sep. 26, 1977

Related U.S. Application Data

[63] Continuation of Ser. No. 686,045, May 13, 1976, abandoned.

[51] Int. Cl.[2] ..... A63F 1/00

[52] U.S. Cl. ..... 273/293; 273/269; 273/295

[58] Field of Search ..... 273/152.1, 135 B, 269, 273/293, 295

[56] References Cited

U.S. PATENT DOCUMENTS

| | | | |
|---|---|---|---|
| 1,246,297 | 11/1917 | Michell | 273/148 A |
| 1,766,465 | 6/1930 | Snelling | 273/152.5 UX |
| 2,474,573 | 6/1949 | Cohen | 273/135 B |
| 3,245,687 | 4/1966 | Irwin | 273/152.1 |
| 3,263,999 | 8/1966 | McCoy | 273/152.1 |
| 3,618,952 | 11/1971 | Tallarida | 273/135 B |

*Primary Examiner*—Anton O. Oechsle

*Attorney, Agent, or Firm*—Kenyon & Kenyon, Reilly, Carr & Chapin

[57] ABSTRACT

A card game in which a plurality of cards are employed each having thereon a plurality of indicia locations arranged to form rows and columns. In each set of cards, two or more sets making up a deck, one card of the set has an opaque indicia at a location different from every other card in that set. The remaining indicia locations on each card are transparent. In playing the game cards are drawn and placed in overlying relationship the object being to get a predetermined pattern of opaque indicia.

10 Claims, 9 Drawing Figures

A DIAGONAL ROW

A HORIZONTAL ROW

A VERTICAL ROW

THE FOUR CORNERS

A BORDER

A FILLED CARD

CARD GAME

This is a continuaton of application Ser. No. 686,045 filed May 13, 1976, abandoned.

BACKGROUND OF THE INVENTION

This invention relates to games in general and more particularly to a card game utilizing cards having opaque and transparent indicia thereon.

Typical card games utilize standard or specialized decks of cards containing on faces thereof markings such as numbers and suits and are generally dealt to the players. In some games such as rummy the object is to obtain groups of like cards. In others, the cards are played and tricks taken.

Another known game is a game such as Bingo or Lotto where players have a card with a plurality of rows and columns thereon and numbers are called off, the players putting markers on the called numbers in attempting to complete a row or column or diagonal in order to win the game.

SUMMARY OF THE INVENTION

The present invention is a new game which combines, in a sense, features of a game such as Bingo and a card game such as rummy. Used in the game is a deck of cards made up of two or more sets of cards with each of the cards having thereon a plurality of indicia locations. On each card the indicia locations are arranged to form N rows and M columns, the number of cards in a set being equal to N × M. On each card one indicia location which is different for each card of a set is made opaque with the remaining indicia locations transparent. During play, the players draw one card at a time and place their cards in overlying relationship. With such an arrangement, because of the transparent nature of the indicia locations other than those which are opaque, the opaque indicia show through all cards. The object of the game is to attain a row, column, diagonal, four corners etc. In the illustrated embodiment, over the columns letters are written on the card to form a word; in the illustrated embodiment the word "ZING" is used. The first player to attain the object can thus call out "ZING" much in the manner a player calls out the word "Bingo" when playing Bingo.

Although, for two players it is sufficient if two sets make up a deck, it is thought that the typical deck should include four sets thereby permitting up to four players to play the game. Where more than four players are playing multiple decks may be used.

Illustrated are two basic manners of constructing the cards. In one, cardboard is utilized with the indicia locations defined by horizontal and vertical lines thereon. The opaque indicia are established by placing a colored, mark in the indicia block desired. To obtain the transparent locations, holes are punched through the remaining indicia locations. In another embodiment, the card is made of transparent plastic with the lines establishing the indicia locations printed thereon along with one indicia location of each card being printed to establish opaqueness. In the illustrated embodiment four columns and four rows are used thereby requiring sixteen cards per set and sixty-four cards in a typical deck. It will be recognized that more or fewer rows and columns can be used as desired thereby increasing or decreasing the size of the set and of the deck.

DETAILED DESCRIPTION OF THE PREFERRED EMBODIMENT

Figure 1:
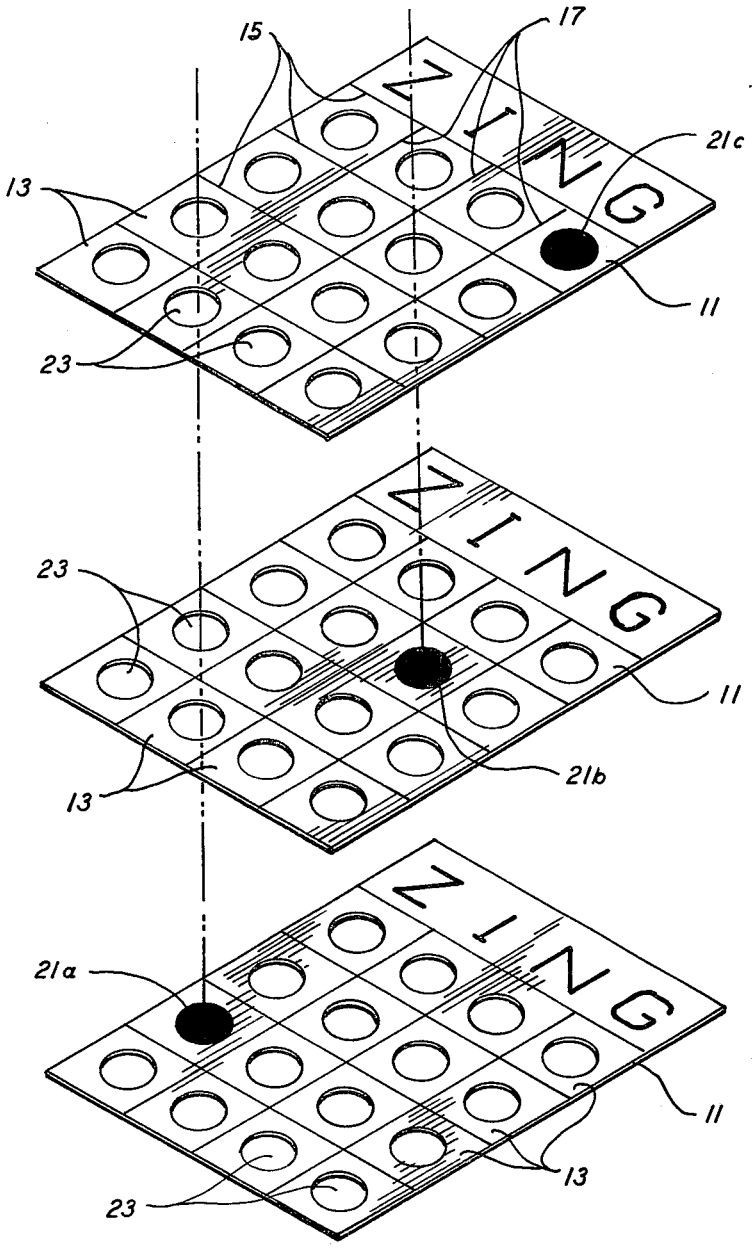
FIG. 1 is an exploded perspective view illustrating a plurality of the cards of the present invention placed in overlying relationship.

Illustrated on FIG. 1 is an example of the manner in which the cards of the present invention are used in the game of the present invention with three cards 11 shown in a exploded perspective view. When playing the game, these cards 11 are be placed one on top of the other and aligned with each other. Each of the cards of the illustrated embodiment contains 16 indicia locations 13 formed into four rows and four columns. To establish the indicia locations, which are in the form of approximately square or rectangular blocks, horizontal lines 15 and vertical lines 17 are printed on the cards. A deck of cards is made up of a plurality of sets of cards. Each set will contain a number of cards equal to the number of rows times the number of columns. If the number of rows are designated as N and the columns as M the number of cards in the set will be M × N. Thus, in the illustrated embodiment there will be sixteen cards in a set. Every card has one of its indicia locations marked with an opaque indicia 21 such as indicia 21*a–c* on FIG. 1. The remaining indicia locations are transparent. In the embodiment of FIG. 1 these are accomplished by forming holes 23 in an opaque card such as a card made of cardboard. Within a set, the indicia location marked on each card is different from every other card. As a result, each set will contain a card with an indicia marking in each of the possible locations. In other words if all cards were placed one on top of each other each indicia location would appear to have a mark. FIG. 1 illustrates the manner in which, as the cards are placed in overyling relationship, the indicia are visible through the cards. Note that the indicia 21*a* of the lowest card is visible through the holes 23 in the two cards above it. Similarly, the indicia 21*b* is visible through the hole 23 in the top card and, of course, the indicia 21*c* is visible since it is on top.

Figure 2:
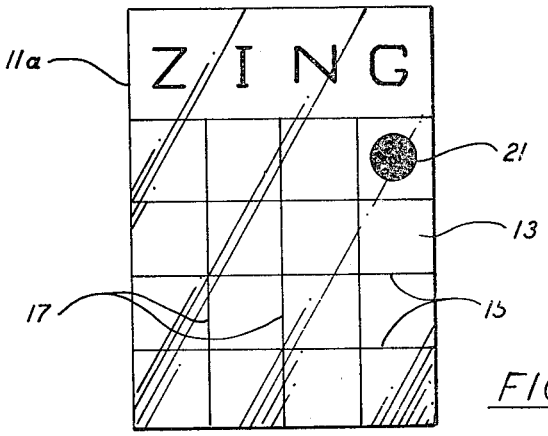
FIG. 2 illustrates a second embodiment of a card of the present invention in plan view.
Figure 3A:
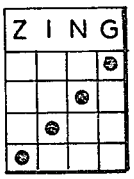
FIGS. 3*a–f* illustrate the patterns which can be obtained and which can be established as the object of the game.
Figure 3B:
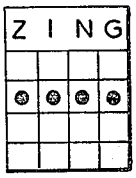
Figure 3C:
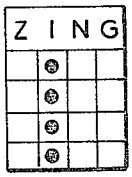
Figure 3D:
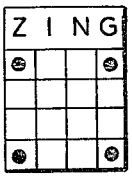
Figure 3E:
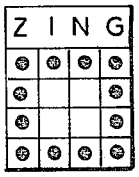
Figure 3F:
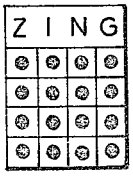

FIG. 2 illustrates a second form of card. In this case the card 11*a* is made of a transparent plastic. Printed on the transparent plastic cards are the horizontal and vertical lines 15 and 17 establishing the indicia locations. As in the previous embodiment one of these locations contains an indicia mark 21. The mark can be in the form of a circle as shown but may also be in other geometric shapes, and if desired may fill the whole square of the indicia location 13. Since the card itself is transparent, there is no need to form holes at the other indicia locations. Simply placing one card on top of the other will make all indicia marks 21 visible to the player.

Both the cards of FIG. 1 and the cards of FIG. 2 have a legend or a word thereover one letter of the word being associated with each column. Chosen for this particular embodiment is the word "ZING". However, other words may also be used. The purpose of having the word is so that the player when he achieves the object of the game can call out something to indicate such an achievement.

With respect to the object of the game, FIG. 3 shows various possibilities which can be established. For example, as shown by FIG. 3*a* a diagonal row can be considered as a winning hand as can a horizontal row as shown in FIG. 3*b* or a vertical row as shown in FIG. 3*c*. Other possibilities are, the four corners shown in FIG. 3*d*, filling in the border as shown in FIG. 3*e* and completely filling a card as shown in FIG. 3*f*. Essentially, any given pattern or group of patterns can be established as a winning hand much in the manner as is presently done in the game of Bingo.

Figure 4:
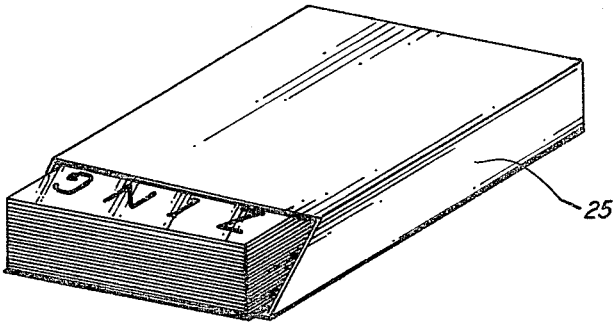
FIG. 4 illustrates a deck of cards in a card holder.

In playing the game, the cards may simply be shuffled and placed on top of the table which with each player taking a card in turn. In accordance with a further feature of the present invention illustrated on FIG. 4, the cards can be placed in a card holder 25 after being shuffled, and the cards then drawn from the card holder. As the players draw cards they place them one on top of the other and play continues until one player has achieved the object of the game i.e. an object such as that described in connection with FIG. 3. The game may also be played like rummy with each player dealt four cards and drawing and discarding then taking place. This introduces a further element of skill into the game.

It is only essential that the deck of cards contain a number of sets of cards equal to the number of players. Thus, the minimum size deck is two sets of cards. However, it is thought that a standard deck should comprise four sets of cards to permit standard play with up to four players. Where more than four players are playing the game additional decks may be used.

What is claimed is:

1. A card game comprising a plurality of cards each having thereon a plurality of indicia locations arranged to form N rows and M columns, there being M indicia locations in each row and N indicia locations in each column, the number of said plurality of cards being at least two identical sets, each set having M times N cards therein, each card in a set having indicia at said indicia locations consisting only of a single opaque indicia at an indicia location different from the location of the single opaque indicia on every other card in the set, the remaining indicia locations in each card being transparent, and a letter above each column of indicia locations, the letters forming a word which can be called out upon attainment of the object of the game whereby when placed in overlying relationship said cards will form pattern of indicia the attainment of at least one pattern of which can be established as the object of the game.

2. A game according to claim 1 wherein said indicia locations are established by placing a plurality of vertical and horizontal lines on said card.

3. The game according to claim 2 wherein four rows and four columns of indicia locations are established by placing said lines.

4. The game according to claim 1 wherein said card is made of an opaque material, said single opaque indicia formed by printing a geometric figure on said card and wherein said transparent indicia locations are obtained by means of punched holes in the remaining indicia locations.

5. A game according to claim 4 wherein said opaque material is cardboard.

6. The game according to claim 1 wherein each of said cards is made of a transparent plastic with said single opaque indicia on each card established by printing thereon.

7. The game according to claim 6 wherein said cards also include horizontal and vertical lines printed thereon to establish the indicia locations.

8. A game according to claim 1 wherein four sets of cards are combined to form a deck.

9. A game according to claim 1 and further including a card holder for the deck of cards from which cards may be drawn by players.

10. The game according to claim 1 wherein there is provided at least one set of cards for each player in the game, the game being adapted for a minimum of two players, and wherein, during play the total plurality of cards are contained in one shuffled pile.

* * * * *